United States Patent [19]

Armstrong

[11] 4,160,538

[45] Jul. 10, 1979

[54] LEG STRUCTURE FOR JACK-UP PLATFORM WITH SINGLE POINT JACKING

[75] Inventor: James E. Armstrong, Crosby, Tex.

[73] Assignee: Pool Company, Dallas, Tex.

[21] Appl. No.: 792,929

[22] Filed: May 2, 1977

[51] Int. Cl.[2] ..... B66F 7/12

[52] U.S. Cl. ..... 254/89 R; 254/95

[58] Field of Search ..... 254/89 R, 95–97, 254/105; 61/91, 90; 405/196, 199

[56] References Cited

U.S. PATENT DOCUMENTS

| | | | |
|---|---|---|---|
| 3,332,663 | 7/1967 | Cargile | 254/107 |
| 3,606,251 | 9/1971 | Willke et al. | 254/95 |
| 3,743,247 | 7/1973 | Willke et al. | 254/95 |

*Primary Examiner*—Robert C. Watson

*Attorney, Agent, or Firm*—Richards, Harris & Medlock

[57] ABSTRACT

A trussed leg structure for use in jack-up mobile offshore platforms of the type that include a plurality of support legs extending into the water down to the ocean floor with jacking units engaging each leg to raise and lower the platform structure relative to the surface of the water. The leg structure disclosed includes a plurality of mutually parallel and laterally spaced apart column members rigidly interconnected to define a triangularly-shaped leg. The leg structure has only a single elongated rack carried on one of the column members to provide single point jacking of the leg. The rack comprises a flat, plate-like rack member having a set of rack teeth extending along each edge for meshed engagement with a separate one of a pair of pinions on a jacking unit. Two of the three column members are made of tubular pipe. The third column member, which carries the elongated rack, is an elongate rack plate oriented perpendicular to a plane defined by the first and second column members. The rack plate in combination with the rack member gives the third column member a generally T-shaped configuration. Cross-bracing extends between adjacent column members and includes horizontal brace members with diagonal brace members extending between adjacent pairs of horizontal brace members.

11 Claims, 3 Drawing Figures

LEG STRUCTURE FOR JACK-UP PLATFORM WITH SINGLE POINT JACKING

BACKGROUND OF THE INVENTION

This invention generally relates to jack-up offshore platforms of the type that include a platform structure, a plurality of support legs extending into the water down to the ocean floor, and jacking units on the platform structure for engaging such support leg to raise and lower the platform structure relative to the surface of the water. More particularly, the present invention relates to a truss leg structure for use in jack-up offshore platforms which have a plurality of mutually parallel and laterally spaced apart column members rigidly interconnected and adapted for use with a rack and pinion jacking system.

The need for additional oil, gas and other mineral resources has in recent years brought about increased activity in the exploration for and recovery of such resources from offshore locations. In order to perform the necessary exploration drilling, production drilling, and in some instances petrochemical-processing, it is necessary to provide a platform structure from which such activities can be conducted. At locations having substantial oil and gas reserves, the approach taken in recovering the minerals has been to erect a permanent platform at the proposed well site and lay pipelines between the platform and the shore to transport the oil and gas to onshore storage or processing facilities. The fixed platform is, however, for the most part limited to situations where the reservoir is large enough to amortize the investment.

As the erection of a fixed platform requires a large capital investment, and consequently the offshore hydrocarbon reservoir must be sufficiently large to justify the investment, there are a large number of smaller wells with respectable quantities of oil and gas which cannot be produced profitably. In order to improve the profitability of the small or marginal offshore reservoirs, mobile offshore platforms have been designed to permit a single platform structure to be utilized at several successive reservoirs.

There are many different jack-up platforms in use today. However, a typical jack-up platform has a buoyant hull that permits transporting of the platforms to well site and has separate support legs that project upwardly from the hull during transport. Once the platform has reached the desired location, the support legs are lowered into contact with the ocean floor and the platform is jacked up to a level above the surface of the water. When operations are finished at a particular location, the structure can be jacked down and moved to another site.

Prior art jack-up-type offshore platforms have typically utilized a trussed leg structure of triangular or other polygonal cross-sectional configurations. The leg structure comprises a plurality of cylindrical column members that are mutually parallel and spaced apart laterally to define the corners of the geometrical shape in which the leg structure is configured. The column members are interconnected by crossbracing that extends between adjacent column members, making the leg a unitary structure. Each column member has a dual rack member in the form of a heavy flat metal bar of elongated rectangular transverse cross-section mounted to it and extending parallel through the longitudinal axis of the column member. Two sets of rack teeth are provided, each extending along a different one of the two edges of the rack member.

In jack-up platforms in the prior art having this type of leg structure, it has been taught to provide for each rack member a jacking unit having a rigid frame carrying the motor and gear reduction equipment arranged to drive pinions arranged in pairs. The axes of rotation for each pair of pinions are usually mutually parallel, horizontal and spaced apart, with the pairs being lined vertically one above the other. Each pair of pinions are spaced apart by a distance that permits each pinion to be meshed with a different one of the sets of rack teeth on a rack carried by a column member.

Typical leg supported offshore platform structures with jacking apparatus of this type are disclosed in U.S. Pat. No. 3,743,247 and U.S. Pat. No. 3,606,251, both to Willke, et al.

Offshore platforms utilizing jacking systems of the rack-and-pinion type typically have three or four separate support legs of equal length. In the case of a triangular or rectangular leg configuration, the number of separate sets of jacking systems can be from a minimum of nine or as many as sixteen. It is not only quite expensive to provide such a large number of jacking systems, but it is also necessary to synchronize the operation of each jacking unit on a particular leg structure to prevent unequal vertical displacement of one portion of the leg structure relative to the remainder.

Other jack-up platform leg structures now in the prior art include those disclosed in U.S. Pat. No. 2,924,077 to LeTourneau; U.S. Pat. No. 3,183,676 to Heitkamp; U.S. Pat. No. 3,851,482 to LeTourneau et al; and U.S. Pat. No. 3,367,119 to Rybicki. The leg structure used in all of the aforementioned patents utilizes one outwardly facing rack surface on each column of the truss leg. Although single faced rack surfaces reduce the amount of material needed to construct the support leg structure, the construction cost remains great. The Rybicki patent also discloses a triangular truss-type leg provided with racks on two columns of the leg.

SUMMARY OF THE INVENTION

It is accordingly an object of the instant invention to provide a leg structure for use in a jack-up offshore platform equipped with rack-and-pinion type jacking system.

It is a further object of this invention to provide a leg structure which provides for single point jacking of the leg.

It is among the further objects of this invention to provide a leg structure wherein single point jacking of the leg is accomplished by mounting to the leg structure a single elongated rack member extending parallel to the longitudinal axis of the leg.

It is among the other objects of this invention to provide a truss-type leg structure for a jack-up platform adapted for rack-and-pinion type jacking which minimizes the amount of material required to construct the leg, thereby reducing the construction cost and weight of the support leg structures of a platform.

The above and other objects are accomplished by the leg structure of the present invention which includes a plurality of mutually parallel and laterally spaced apart column members interconnected to form a unitary truss-type structural member having a polygonal cross-sectional configuration. The leg structure further includes a rack structure carried on only a single column member to provide the leg with single point jacking.

In a more specific aspect, the rack structure carried on the column member includes a flat, plate-like member having a set of teeth extending along each of the two opposed edges of the member. In a yet more specific aspect, the column members are interconnected by horizontal and diagonal cross-bracing to provide the leg structure with a triangular cross-sectional configuration.

In accordance with yet a more specific aspect of the invention, the rack structure carried on the column member has two sets of rack teeth for engagement with a pair of pinions on a jacking unit, each of the sets of rack teeth being meshed with a different one of the pinions.

In another aspect of the invention, an improvement is provided in truss leg structures used in jack-up offshore platforms, which leg structures comprise a plurality of mutual parallel and laterally spaced apart column members. The improvement is a column member which comprises an elongated rack plate and a stem plate oriented perpendicular to the rack plate and secured to it. In combination the adjacent rack plate and the stem plate give a generally T-shaped form to the column member.

DESCRIPTION OF THE DRAWINGS

A more complete appreciation of the invention may be had by reference to the particular embodiment which is described below and is illustrated in the accompanying drawings, wherein.

DETAILED DESCRIPTION OF A PREFERRED EMBODIMENT

Figure 1:
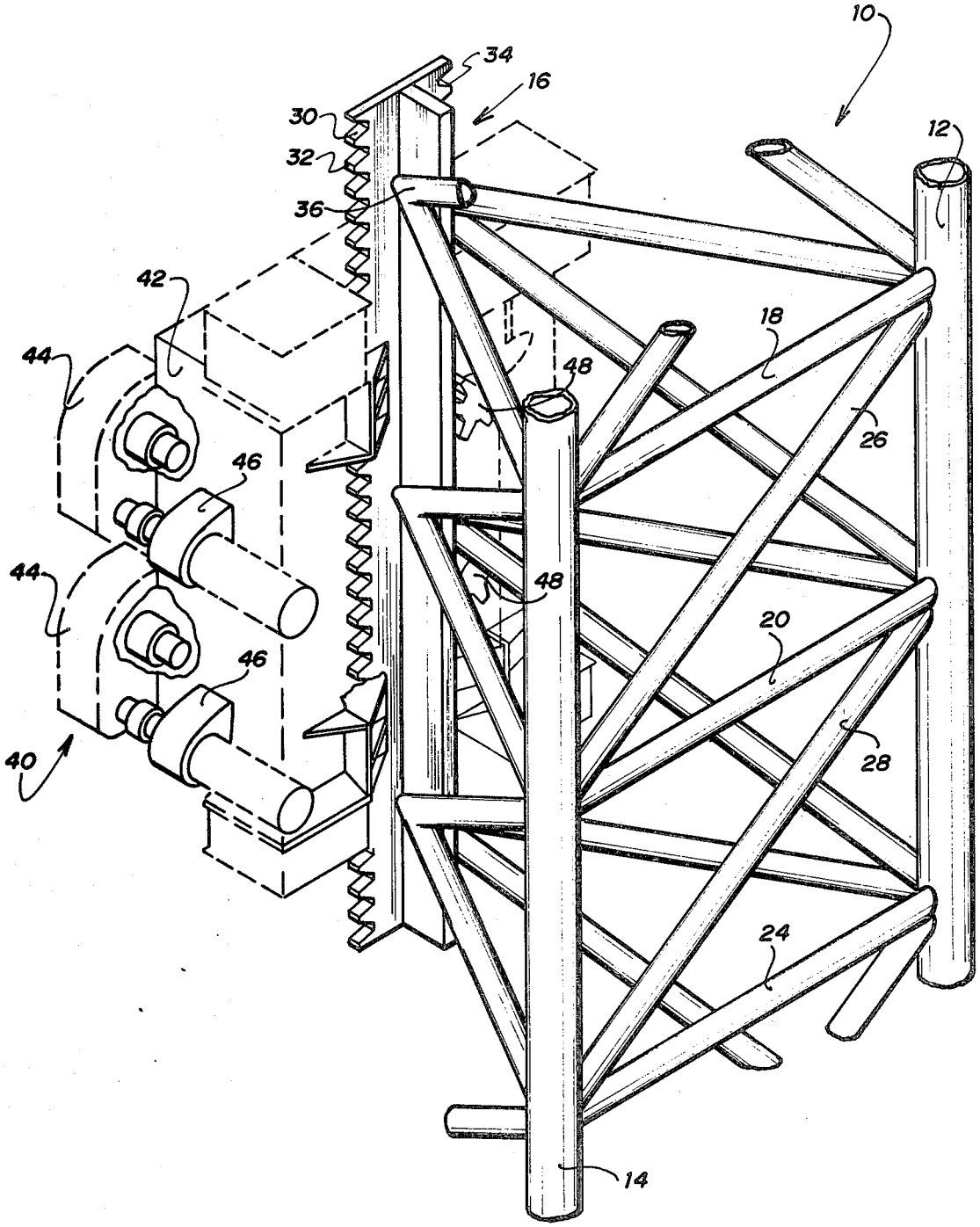
FIG. 1 is in perspective view of a section of a support leg in accordance with the present invention for a jack-up offshore platform.

Referring now to FIG. 1 of the drawings, a leg structure 10 in accordance with the present invention is shown. Leg structure 10 is of a truss-type construction having column members 12, 14 and 16. The column members are mutually parallel and spaced apart laterally to define a triangular cross-sectional configuration. Column members 12, 14 and 16 are rigidly interconnected by cross-bracing between adjacent column members. For example, horizontal brace members 18, 20 and 24 extend between column members 12 and 14 and connect at the ends to each of the members. Extending between each adjacent pair of horizontal brace members is a diagonal brace member. For example, between adjacent horizontal brace members 18, 20 there is a diagonal brace member 26. Between horizontal brace members 20, 24 is diagonal cross-brace 28. Similar cross-bracing extends between column members 12 and 16 and between column members 14 and 16.

Column member 16 carries a rack member 30. In this embodiment, rack member 30 is an elongated flat plate having a rectangular cross-sectional configuration. Rack member 30 has two sets of rack teeth 32 and 34, each of which extends along one edge of the member.

Figure 2:
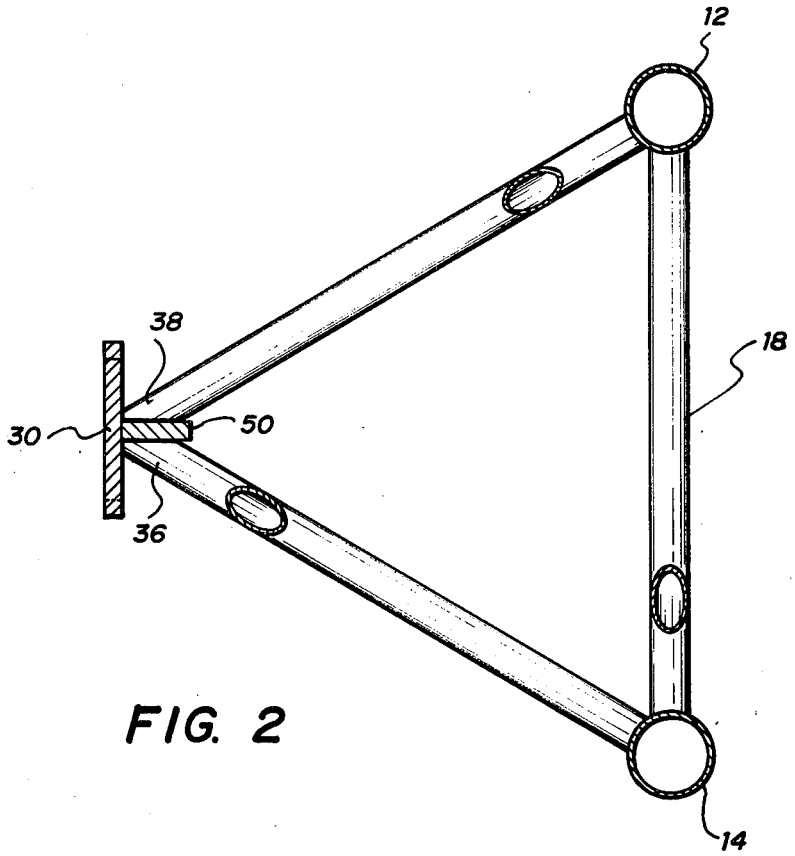
FIG. 2 is a top view of a support leg structure in accordance with the present invention.

Referring briefly to FIG. 2, it will be seen that the sets of teeth 32 and 34 lie in a common plane which extends parallel to horizontal cross-braces 18, 20 and 24 that interconnect column members 12 and 14. It can be further appreciated from reference to FIG. 2 that each set of rack teeth is spaced outwardly from the end connection points 36 and 38 of the horizontal brace members extending between column members 12 and 14. The width of rack member 30 is sufficient to permit access of the sets of rack teeth by the pinions of the jacking unit 40 shown in dotted outline in FIG. 1.

Referring once again to FIG. 1, the sets of teeth 32 and 34 on rack member 30 are adapted for meshed engagement by pinions on the jacking unit 40. The jacking unit 40 includes a frame 42 having motors 44 and associated gear reduction equipment 46 for driving pinions 48. Pinions 48 are arranged in pairs, with the pairs being aligned vertically one above the other. The pinions of each pair are laterally spaced apart to be positioned on opposite sides of rack member 30 to mesh with sets of teeth 32 and 34 on rack member 30.

With jacking unit 40 in position and pinions 48 properly meshed with the two sets of rack teeth, rotation of the pinions of each pair in opposite directions will result in the translation along rack member 30 of jacking unit 40. With jacking unit 40 secured to a platform structure, operation of the unit will result in lifting or lowering of the platform relative to the leg structure along a single column member of each leg, and therefore provide single point jacking.

As shown in FIG. 1, column members 12 and 14 are tubular in configuration. In the embodiment shown, however, column 16 is of a different cross-sectional configuration. More specifically, column member 16 is of a T-shaped cross-section.

Figure 3:
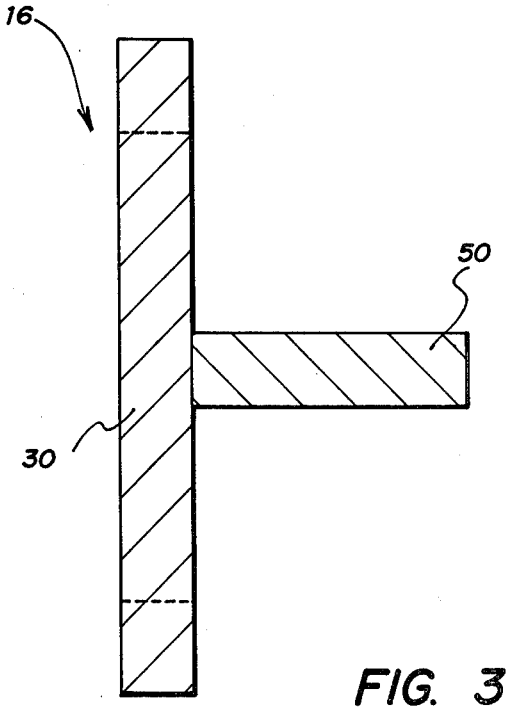
FIG. 3 is a close-up view of the column member in the support leg structure that carries the rack to be engaged by a jacking unit.

As best shown in FIG. 3, column member 16 comprises in combination rack member 30 which, as previously described, is formed from a flat plate of a rectangular cross-section. Rack plate 50 is similarly a flat plate of a rectangular cross-section. Plate 50 is oriented perpendicular to rack member 30 and secured thereto along the entire length of one edge. As can be seen in FIG. 1, the horizontal and diagonal cross-braces that extend between column member 16 in each of column members 12 and 14 attach to the sides of rack plate 50.

When installed in a jack-up offshore plateform, a leg in accordance with the present invention, and more particularly in accordance with the embodiment shown and described herein, will be maintained in a perpendicular relationship with the horizontal surface of the platform deck by guide surfaces that engage columns 12 and 14.

The foregoing description of the invention has been directed to a particular preferred embodiment for purposes of explanation and illustration. It will be understood, however, that the invention is not limited to the embodiment disclosed and that many modifications and changes in the structure may be made without departing from the scope of the invention. Accordingly, it is the applicant's intention of the following claims to cover all equivalent modifications and variation as fall within the scope of the invention.

What is claimed is:

1. A leg structure for engagement by a jacking unit on an offshore platform for moving the platform relative to the leg structure, comprising:

first and second elongated, laterally spaced apart parallel column members;

a third elongate column member parallel to both of said first and second column members;

cross-bracing extending between said first, second and third members to rigidly interconnect the same and provide a unitary structure having a triangular cross-sectional configuration; and a single elongated rack means carried on said third elongate member to provide for jacking of the leg only on said rack means, said rack means comprising a flat, plate-like member having a set of rack teeth extending along each edge for meshed engagement with a separate one of a pair of pinions on the jacking unit.

2. The leg structure of claim 1 wherein said first and second elongated column members each comprises a cylindrical tubular member.

3. The leg structure of claim 1 wherein said cross-bracing comprises horizontal brace members with diagonal brace members extending between adjacent pairs of horizontal brace members.

4. A leg structure for a jack-up offshore platform comprising:

a plurality of mutually parallel and laterally spaced apart column members interconnected to form a unitary truss-type structural member having a polygonal cross-sectional configuration; and rack means carried on only a single column member to provide for jacking of the leg relative to the platform only on said rack means.

5. The leg structure of claim 4 wherein said rack means comprises a flat, plate-like member having a set of teeth extending along each of the two opposed edges of said member.

6. The leg structure of claim 4 wherein said elongate truss-type structural member is of a triangular cross-sectional configuration.

7. The leg structure of claim 4 wherein said rack means has a T-shaped cross-section configuration, with the stem portion of said T-shaped rack means forming one of said column members.

8. The leg structure of claim 4 wherein said rack means comprises two sets of rack teeth for engagement with a pair of pinions on a jacking unit, each of said sets of rack teeth to be meshed with a different one of the pinions.

9. The leg structure of claim 4 wherein said mutually parallel column members are interconnected by horizontal and diagonal cross-bracing extending between adjacent column members.

10. In a trussed leg structure for use in a jack-up offshore platform, which leg comprises a plurality of mutually parallel and laterally spaced apart column members rigidly interconnected to define a triangular cross-sectional configuration for said leg, a column member which comprises:

an elongate rack member; and a rack mounting plate oriented perpendicular to said rack member and secured at one longitudinal edge thereto and at the opposite edge to other of the column members, said rack member in combination with said rack mounting plate giving a generally T-shaped form to the column member.

11. The column member of claim 10 wherein said rack member has first and second sets of rack teeth extending along opposing parallel edges separated by the wider side portion of said rack member.

* * * * *